US006795984B1

(12) United States Patent
Brady

(10) Patent No.: US 6,795,984 B1
(45) Date of Patent: Sep. 28, 2004

(54) SPA COVER LIFTING DEVICE

(76) Inventor: James P. Brady, Ideal Spa Covers, Inc., 305 W. Maple Ave., Orange, CA (US) 92866-1323

( * ) Notice: Subject to any disclaimer, the term of this patent is extended or adjusted under 35 U.S.C. 154(b) by 0 days.

(21) Appl. No.: 10/339,068

(22) Filed: Jan. 8, 2003

(51) Int. Cl.[7] ..... E04H 4/00

(52) U.S. Cl. ..... 4/498; 4/500; 220/263

(58) Field of Search ..... 4/498, 500; 220/263, 220/264, 810, 744, 817, 314, 252; 49/280, 349; 280/763.1; 296/100; 135/907

(56) References Cited

U.S. PATENT DOCUMENTS 3,306,655 A * 2/1967 Voehringer ..... 49/280
3,333,362 A * 8/1967 Kostin et al. ..... 49/349
4,185,415 A * 1/1980 LaConte ..... 49/248
4,333,269 A * 6/1982 Bascou ..... 49/280
5,048,153 A * 9/1991 Wall et al. ..... 16/223
5,131,102 A * 7/1992 Salley et al. ..... 4/498
5,299,722 A * 4/1994 Cheney ..... 220/521
5,566,403 A 10/1996 Black et al. ..... 4/498
5,634,218 A * 6/1997 Ouelette ..... 4/498
5,689,841 A 11/1997 Black et al. ..... 4/498
5,950,252 A * 9/1999 Fettes ..... 4/498
5,996,137 A * 12/1999 Genova ..... 4/498
6,000,071 A * 12/1999 Fettes ..... 4/498
6,032,305 A * 3/2000 Tedrick ..... 4/498
6,601,834 B2 * 8/2003 Perry ..... 267/64.12

* cited by examiner

*Primary Examiner*—Gregory L. Huson
*Assistant Examiner*—Khoa Huynh
(74) *Attorney, Agent, or Firm*—Cislo & Thomas LLP

(57) ABSTRACT

A spa cover lifting device employs a pivot bar attached to a piston and transverse bar. The pivot bar and piston are anchored adjacent to a spa, and the transverse bar extends in a perpendicular direction across the spa cover. The pivot bar is anchored to the spa by a first mounting bracket, and the piston is anchored to the spa by a separate, second mounting bracket. As the pivot bar is raised, it is augmented by the piston to assist in lifting the spa cover, while the transverse bar transfers the lifting force to the spa cover.

16 Claims, 4 Drawing Sheets

SPA COVER LIFTING DEVICE

BACKGROUND OF THE INVENTION

1. Field of the Invention

This invention relates to spa covers, and more particularly to spa cover lifting devices.

2. Description of the Related Art

A spa usually has a cabinet forming the tub of the spa and a thick two-piece cover, which is removed when using the spa. The two pieces of the cover are generally hinged together such that one piece is folded over the other when removing the cover. The cover is often bulky and can be difficult to lift.

Prior attempts to ease lifting the cover have resulted in various spa cover lifting devices. However, existing devices typically include exposed hardware which is visible to the spa owner, and non-rigid engagement between the lifting device and spa cover.

One such lifting device is disclosed in U.S. Pat. No. 5,689,841 issued to Black, et al. The Black patent discloses a spa cover lift apparatus which includes an engagement assembly comprising engagement arms which are inserted along the seam or hinge which joins the two pieces of the cover so as to be a noninvasive, readily-reliable engagement with the spa cover. The engagement arms are positioned above and adjacent to the cover, and there is a single large bracket for attaching the device to the spa. This structure results in a substantial amount of exposed hardware and a non-rigid connection between the cover and lifting apparatus.

What is needed is a more secure attachment of the cover and the lifting device, which is more reliable, less likely to slip, and is stronger than prior devices, with a minimum of exposed hardware.

SUMMARY OF THE INVENTION

The present invention provides a spa cover lifting device comprising a pivot bar having a proximal end connected to a surface adjacent to a spa, a distal end connected to the spa cover, a piston, for example, a gas shock, with a proximal end connected to a surface adjacent to a spa and a distal end connected to the pivot bar, and a transverse beam passing through the cover, with a proximal end attached to the pivot arm and an edge of the cover, and a distal end attached to an opposite edge of the cover.

The pivot bar may include an extension arm within a bore defined by the outer surface of the pivot bar. The transverse beam, located at a predetermined distance from the spa cover hinge, passes through a bore extending through the cover, where the bore includes a proximal aperture configured for permanent engagement with the proximal end of the transverse beam, and a distal aperture configured for permanent engagement with the distal end of the transverse beam. The upper end of said gas piston may include locking knob for securing the device and cover in the desired position.

Alternatively, a spa cover utilizing the lifting device of the present invention may have two lifting devices, one on either side of the cover. The bar preferably attaches to the end of each extension arm, providing a smooth rigid assembly and minimizing the amount of assembly pieces required. The device may also have two brackets for separately mounting the pivot bar and the piston, and the piston-mounting bracket may have a portion that provides support for the circumference of a sleeve for rotatably supporting the pivot bar, proximate where the pivot bar is connected to the pivot bar-mounting bracket.

DESCRIPTION OF THE PREFERRED EMBODIMENT(S)

The detailed description set forth below in connection with the appended drawings is intended as a description of presently preferred embodiments of the invention and is not intended to represent the only forms in which the present invention may be constructed and/or utilized. The description sets forth the functions and the sequence of steps for constructing and operating the invention in connection wit h the illustrated embodiments. However, it is to be understood that the same or equivalent function s and sequences may be accomplished by different embodiments that are also intended to be encompassed within the spirit and scope of the invention.

Figure 1:
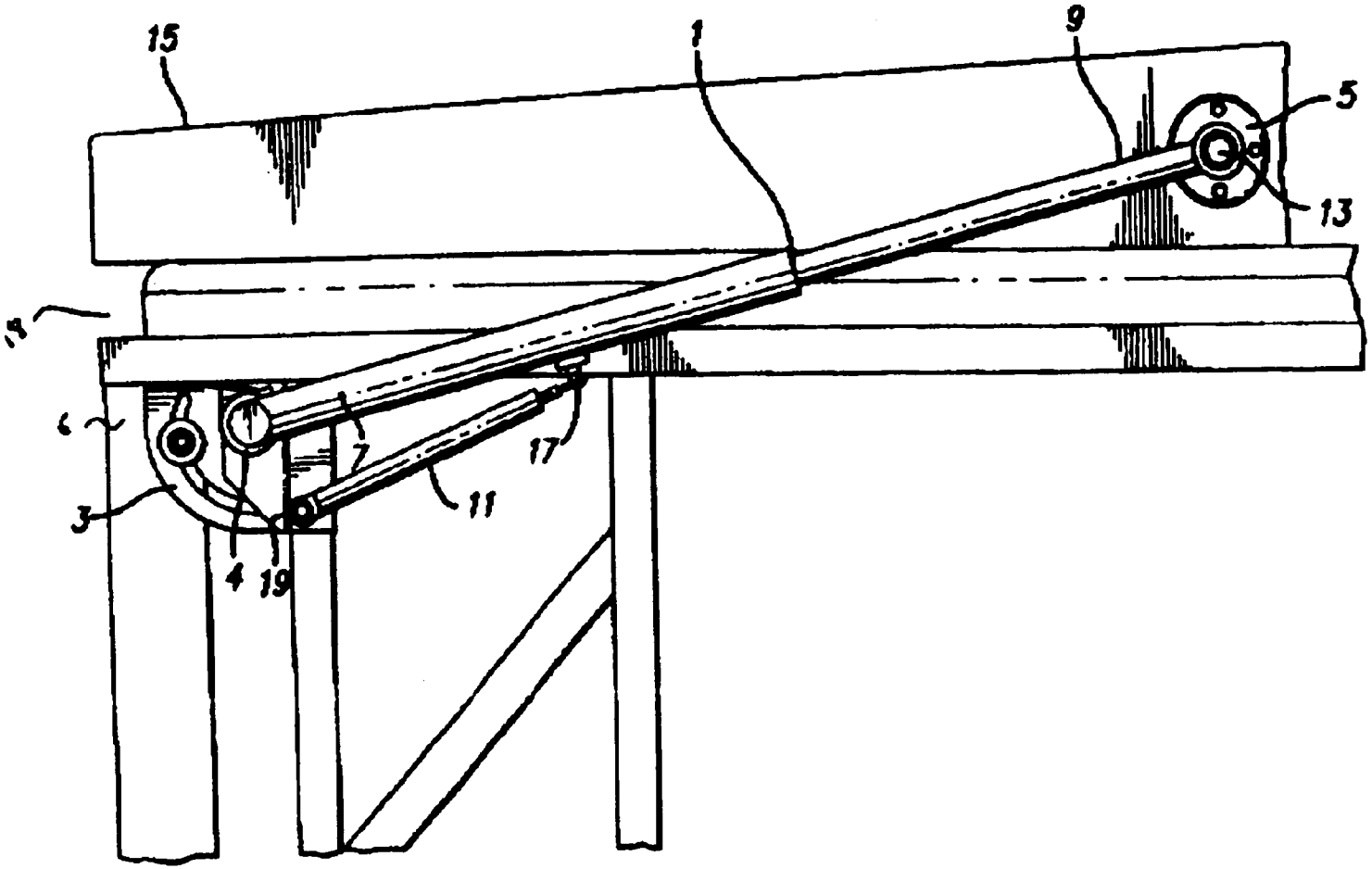
FIG. 1 is a profile view of an embodiment of a spa cover lifting device.

A spa cover lifting device includes a pivot bar, a piston, such as a gas shock, and a transverse bar. An exemplary configuration of the present invention is illustrated in FIG. 1. Pivot bar 1 is connected at one end to a first mounting bracket 3, and at another end via a rigid connecting element 5. Pivot bar 1 may be a single piece, or may have a tubular lower portion 7, and upper portion or extension arm 9 for making the pivot bar 1 longitudinally adjustable to accommodate different spa and spa cover sizes.

Lower portion 7 may define a lumen which receives extension arm 9 in sliding engagement. Additionally, the lower portion 7 and extension arm 9 may be hollow tubes provided with holes, wherein the extension arm 9 may be locked in place once the bar 1 is adjusted via a locking pin (not shown in the figures). Other methods of making the bar 1 adjustable, for example, by providing a retaining element such as a clamp on extension arm 9, or screw which screws through a hole on lower portion 7 and presses against extension arm 9 to hold it in place will be apparent to one skilled in the art.

Figure 2:
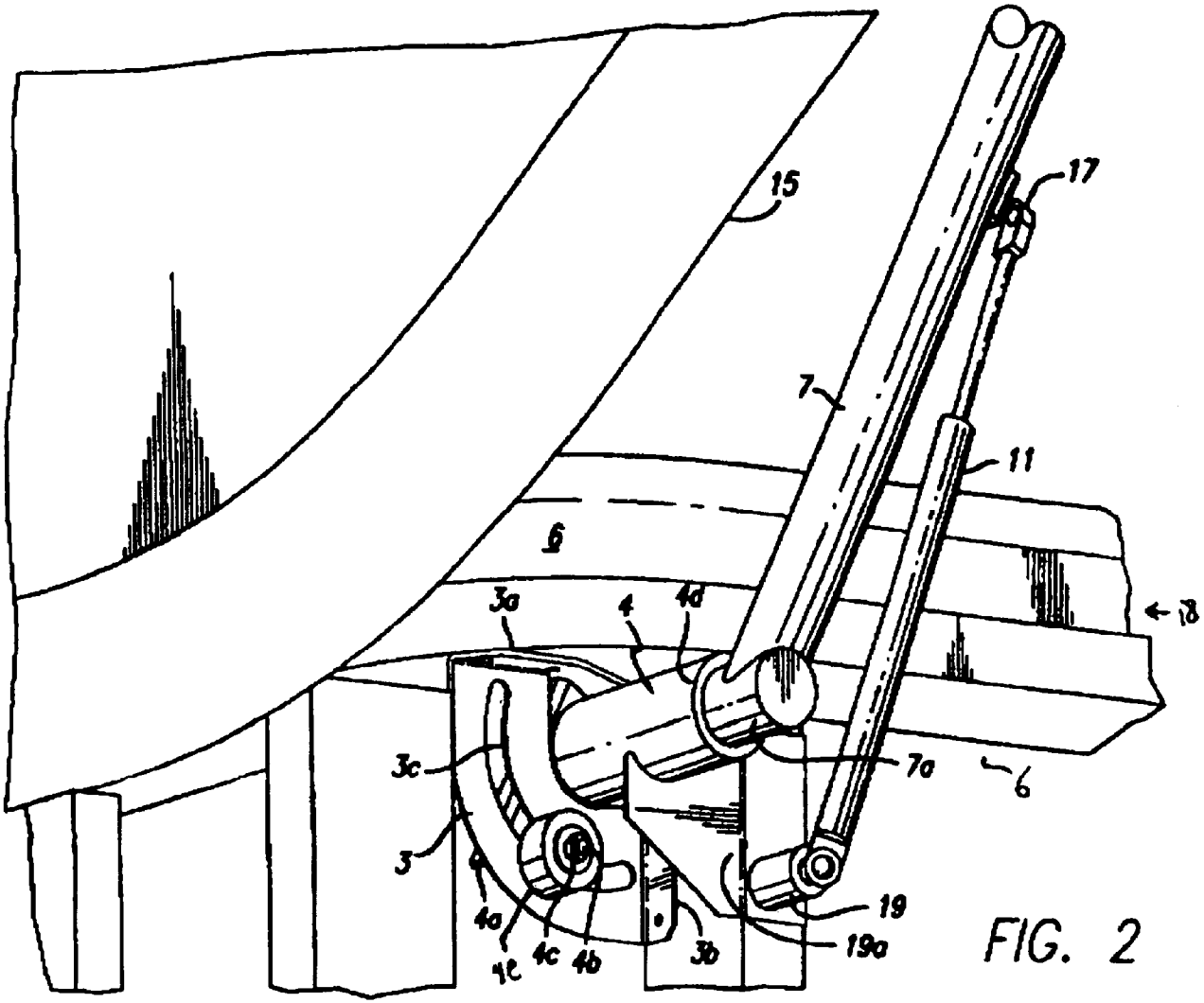
FIG. 2 is a perspective view of an embodiment of an anchoring device for a spa cover lifting device.

Mounting bracket 3 may be a channel bracket as shown in FIG. 2, a hinge, or any other mounting apparatus, or otherwise anchoring device that allows the pivot bar 1 to rotate about the anchoring device.

Bracket 3 is constructed so as to minimize the exposed hardware, and is preferably positioned below the spa rim 18, to the underside and inside of the spa cabinet or spa cabinet support 6. With reference to FIG. 2 also, bracket 3 has a flange 3*a* and a flange 3*b* for being connected, e.g., by bolts, to the underside and inside of the spa cabinet or spa cabinet support 6. The channel bracket 3 has a channel 3*c* to which a flange 4*a* of a mounting sleeve 4 is adjustably attached by a bolt 4*b* and nut 4*c*, at a desired angle. Preferably, a damping device, such as a thick rubber ring 4*e* is provided between the bracket 3 and bolt and nut, to keep the mounting sleeve 4 from freely rotating without external force.

Sleeve 4 further has a cylindrical element 4*d* which extends perpendicular or transverse to lower portion 7 of bar 1. It rotatably receives a perpendicular or transverse member 7*a* of lower portion 7. This perpendicular or transverse arrangement enables bracket 3 to be located under spa cabinet or support 6, and thus minimizes exposed hardware.

The mounting bracket is shown as being attached to a spa support 6, which may be a portion of the spa base, but it also may be any location adjacent the spa, such as the deck or ground for an in-ground spa.

Connector 5 may include a circular plate 5*a* bolted to the cover, and may be formed as part of pivot bar 1 or extension arm 9, or connector 5 can be a separate article. Plate 5*a* can be attached to the cover by adhesive, bonding, use of fasteners to the cover, or any other conventional technique such as bolting to a circular plate located on the inside of the cover and integral or unitary with a transverse bar 13.

Connector 5 may be fixed or adjustable with respect to transverse bar 13, hence making the distance between the pivot bar 1 and spa cover adjustable. This would allow transverse adjustment of the device to accommodate different sized spa covers, since the distance which the spa cover extends with respect to the mounting location may vary depending on the size of the cover and mounting location.

One way of making the connector 5 adjustable is to provide an inner circular plate (not shown in the figures) located on the inside of the cover and connectable to circular plate 5*a*, (e.g. via a nut and bolt connection) wherein the position of the inner circular plate is slidably adjustable on transverse bar 13. Once adjusted, the position of the inner plate may be fixed by a retaining element, such as a steel clamp or ring on the bar 13. Other methods of making the connector, or otherwise distance between the pivot bar 1 and spa cover, adjustable will be apparent to one of ordinary skill in the art.

It should be noted that the length of the pivot arm 1 and its distance from the spa cover would only have to be adjusted upon installation of the lifting device.

Piston 11 can be a gas shock of conventional design, but can also be hydraulic or electrically actuated, if desired.

The lower end of piston 11 is attached adjacent to the spa in a manner similar to pivot bar 1, using a separate second mounting bracket 19 as shown in FIG. 2, or a combined anchoring device if preferred.

Second bracket 19 may have a support flange 19*a* with a curved surface to help support sleeve 4 and further enable the use of this sleeve 4 to position the first bracket 3 under the spa cabinet or support 6.

The upper end of piston 11 is attached to pivot bar 1, at attachment point 17 in a conventional manner so that it can augment the movement of the pivot arm when raising or lowering the spa cover.

Figure 3:
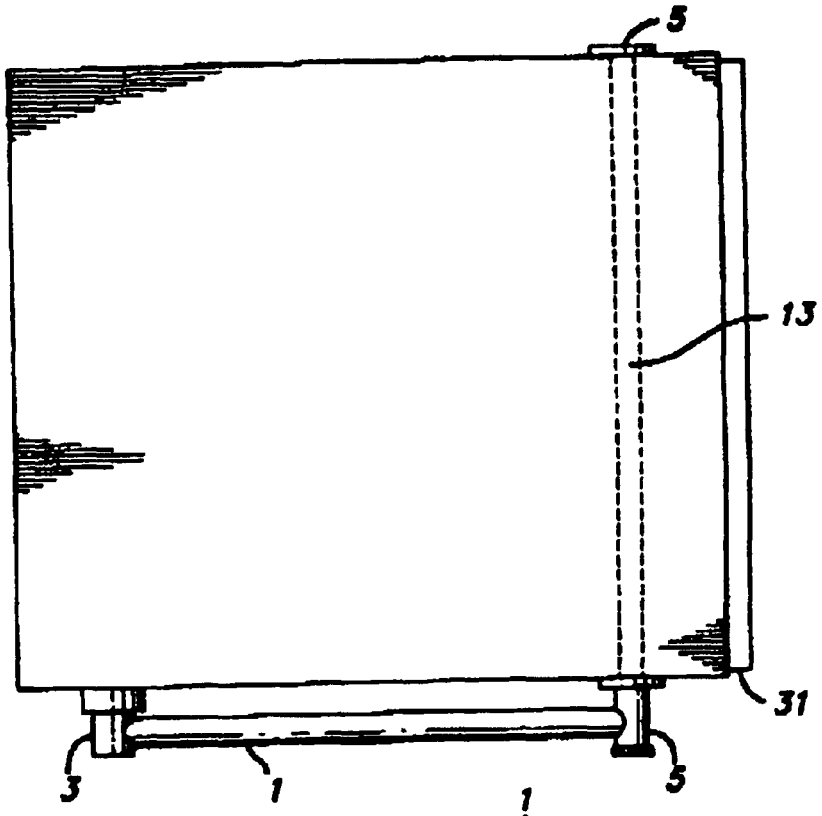
FIG. 3 is an elevation view of an embodiment of a spa cover lifting device.
Figure 5:
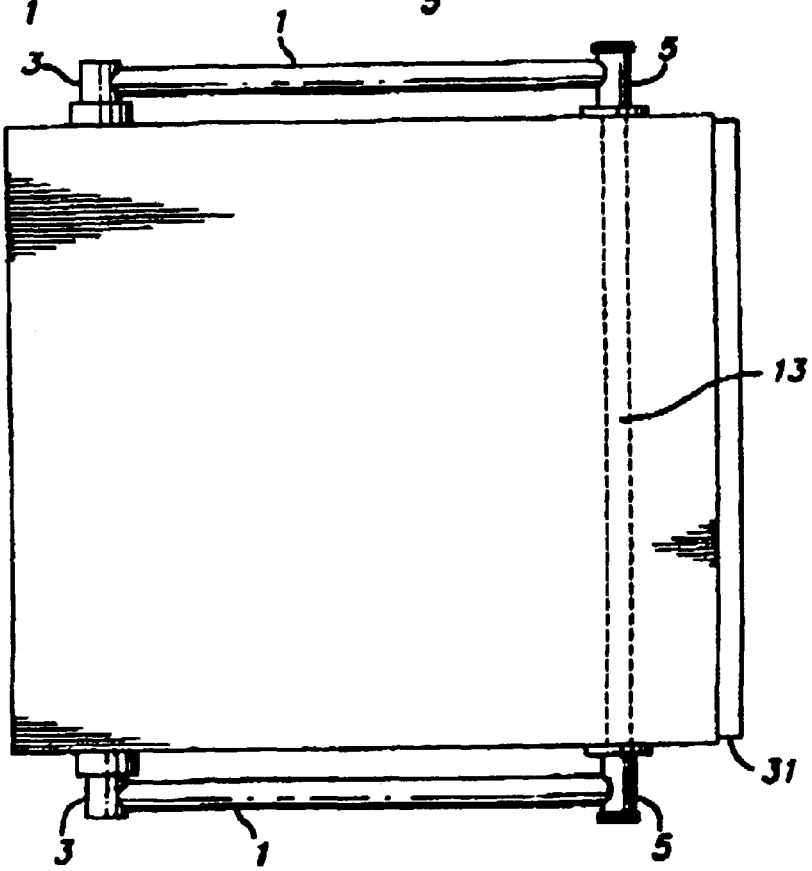
FIG. 5 is an elevation view of an embodiment of a spa cover lifting device with two lifting assemblies.
Figure 4:
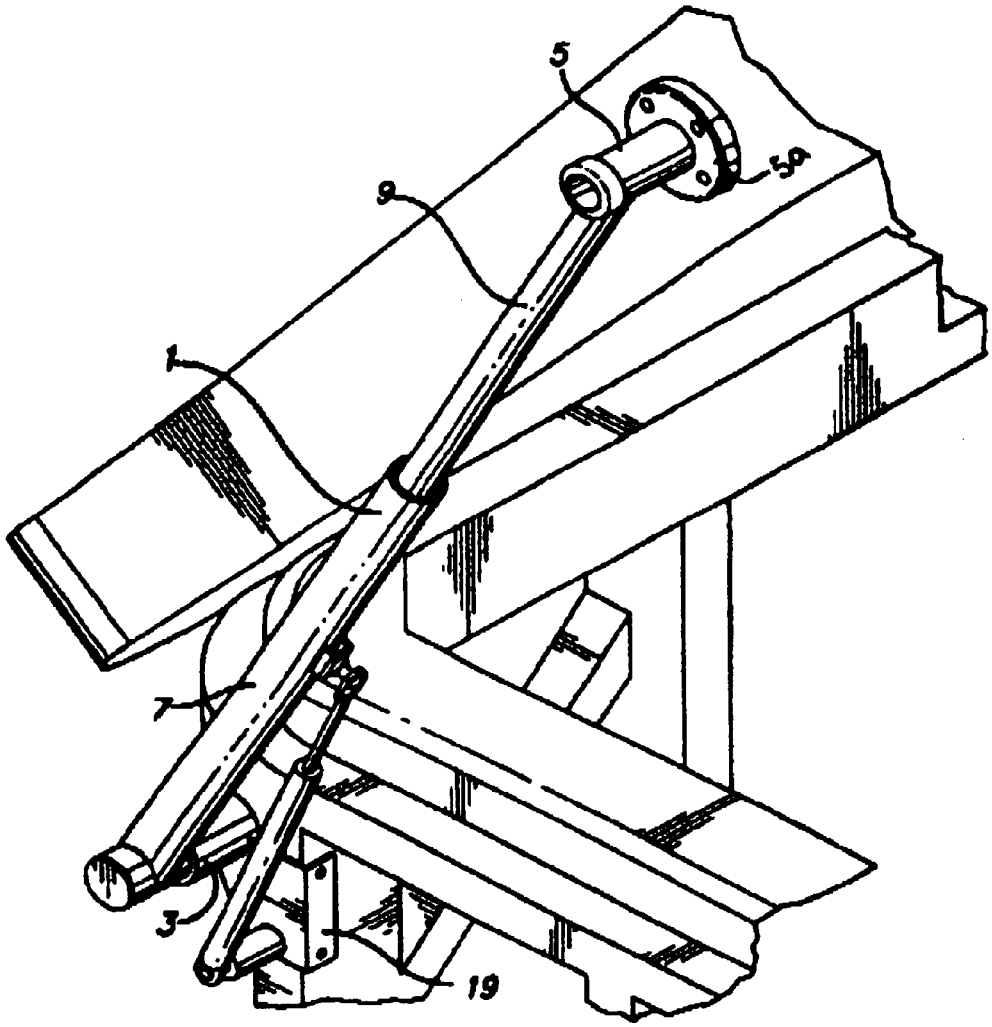
FIG. 4 is a perspective view of an embodiment of a spa cover lifting device in the raised position.

Transverse bar 13 extends across the cover in a perpendicular direction relative to pivot arm 1. Transverse bar 13 may be of any desired shape, and can be attached to rigid connector 5 in a manner similar to that of pivot bar 1, at opposite edges of the spa cover. Transverse bar 13 preferably extends through the cover itself, at a predetermined distance from cover edge 31 as shown in FIG. 3, or above or below the cover if desired. The transverse bar 13 may also extend only partially through the cover. In an alternative embodiment, two lifting devices are employed on opposite sides of a spa. In this embodiment, the transverse bar may be placed in a position other than through the cover so long as each end is connected to a respective lifting device. Rigid connector 5 can be configured to protrude horizontally from the spa cover 15 as shown in FIG. 4, to provide an operating handle.

Thus, to operate the device, an operator simply grasps rigid connector 5, and lifts in an upward motion. Piston 11 provides the necessary power to assist in lifting the cover so that the operator can raise the cover to a full upright position as suggested in FIG. 4.

The device may further be provided with a locking mechanism to secure the device and cover in the upright position.

While the present invention has been described with regards to particular embodiments, it is recognized that additional variations of the present invention may be devised without departing from the inventive concept.

What is claimed is:

1. A spa cover lifting device comprising:

a pivot bar having a proximal end for connection to a spa support, and a distal end adapted to rigidly couple to a cover, wherein said distal end of said pivot bar comprises an extension arm slideably engaged with a bore defined by the outer surface of said pivot bar;

a piston having a proximal end for connection to the spa support, and a distal end connected to said pivot bar;

a transverse beam, passing through said cover, having a proximal end and a distal end, and means for attaching the transverse beam to said cover at said proximal and distal ends; and a mounting bracket including a curvilinear channel configured to couple to said pivot bar, wherein said pivot bar pivots about an axis below a spa rim.

2. The spa cover lifting device of claim 1, wherein said piston comprises a gas shock.

3. The spa cover lifting device of claim 2, wherein said transverse beam passes through a bore extending through the spa cover.

4. The spa cover lifting device of claim 3, wherein said bore includes a proximal aperture, said proximal aperture configured for permanent engagement with said proximal end of said transverse beam.

5. The spa cover lifting device of claim 4, wherein said bore includes a distal aperture, said distal aperture configured for permanent engagement with said distal end of said transverse beam.

6. A spa cover lifting device in combination with a spa cover, the combination comprising;

a spa cover with a bore extending from a first side edge to an opposite second side edge of said cover; a transverse rod having first and second end extending through said cover at said first and second side edges, respectively;

a pivot bar, rigidly connected at one end to said first end of said transverse rod, and for connection at another end to a spa support;

a piston, with an upper end and a lower end, said upper end connected to said pivot bar, and said lower end connected to the spa support; and a mounting bracket including a curvilinear channel configured to couple to said pivot bar, wherein said pivot bar pivots about an axis below a spa rim.

7. The combination of claim 6 wherein said pivot bar comprises an upper portion and a lower portion, said lower portion comprising a tube defining a lumen for receiving said upper portion, wherein said lower portion is attached to said support and said upper portion is rigidly attached to said transverse rod.

8. The combination of claim 6 wherein said transverse rod is located at a predetermined distance from a spa cover hinge.

9. A spa cover lifting device in combination with a spa cover comprising:

a spa cover with a bore extending from one side edge to an opposite side edge;

a transverse rod extending through the bore of the spa cover at the one side edge and the opposite side edge;

two pivot bars, positioned on opposite sides of said spa cover; wherein each pivot bar is coupled at one end to said transverse rod, and to a spa cabinet support; and two pistons, each with an upper end and a lower end, said upper ends connected to said pivot bars, and said lower ends connected to said spa cabinet support, wherein said spa cabinet support are coupled to a spa, and include curvilinear channels coupled to said pivot bars.

10. The combination of claim 9 wherein said pivot bars comprise upper and lower portions, each of said lower portions comprising a tube defining a lumen for receiving said upper portion, wherein said lower portions are attached to said spa cabinet support and said upper portions are rigidly attached to said transverse rod.

11. The spa cover lifting device of claim 10 wherein said transverse beam is located at a predetermined distance from a spa cover hinge.

12. A spa cover lifting device in combination with a spa cover comprising:

a spa cover with a bore extending from one side edge to an opposite side edge;

a transverse rod; coupled to the spa cover at the one side edge and the opposite side edge;

two pivot bars, positioned on opposite sides of said spa cover, said pivot bars each rigidly connected at one end to a respective end of said transverse rod, and at another end to first mounting brackets attached to a spa cabinet support;

two pistons, each with an upper end and lower end, said upper ends connected to said pivot bars, and said lower ends connected to second mounting brackets attached to said spa cabinet support, wherein said spa cabinet supports are coupled to a spa, and include curvilinear channels coupled to said pivot bars.

13. The combination of claim 12 wherein said first mounting bracket is located on the underside of the spa cabinet support.

14. The combination of claim 12 wherein said first mounting bracket includes a sleeve positioned transverse to the pivot bar, and the pivot bar has a portion extending transversely for rotatable support by the sleeve.

15. The combination of claim 14 wherein said first mounting bracket includes a sleeve positioned perpendicular to the pivot bar, and the pivot bar has a portion extending perpendicularly for rotate able support by the sleeve.

16. The combination of claim 14 wherein the second mounting bracket has a flange for supporting the sleeve of the first mounting bracket.

* * * * *